US010267329B2

(12) United States Patent
Pyron et al.

(10) Patent No.: US 10,267,329 B2
(45) Date of Patent: Apr. 23, 2019

(54) LABYRINTH CHAMBER FOR HORIZONTAL SUBMERSIBLE WELL PUMP ASSEMBLY

(71) Applicant: Baker Hughes Incorporated, Houston, TX (US)

(72) Inventors: Steven W. Pyron, Tulsa, OK (US); Jason Hill, Catoosa, OK (US); David Tanner, Broken Arrow, OK (US); Ryan Semple, Owasso, OK (US); Ignacio Martinez, Tulsa, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 136 days.

(21) Appl. No.: 15/429,333

(22) Filed: Feb. 10, 2017

(65) Prior Publication Data

US 2017/0260990 A1 Sep. 14, 2017

Related U.S. Application Data

(60) Provisional application No. 62/305,855, filed on Mar. 9, 2016.

(51) Int. Cl.
*E21B 43/12* (2006.01)
*F04D 13/10* (2006.01)
(Continued)

(52) U.S. Cl.
CPC ..... *F04D 29/061* (2013.01); *E21B 43/128* (2013.01); *F04D 13/10* (2013.01); *F04D 29/086* (2013.01); *F04D 1/00* (2013.01)

(58) Field of Classification Search
CPC ..... E21B 43/126; E21B 43/129; E21B 43/127
See application file for complete search history.

(56) References Cited

U.S. PATENT DOCUMENTS 4,421,999 A 12/1983 Beavers et al.
5,367,214 A 11/1994 Turner, Jr.
(Continued)

FOREIGN PATENT DOCUMENTS

WO 2011119749 A2 9/2011

OTHER PUBLICATIONS

A. Gallup, et al., "ESP's Placed in Horizontal Lateral Increase Production," Oil & Gas Journal, Jun. 1990.
(Continued)

*Primary Examiner* — Cathleen R Hutchins
(74) *Attorney, Agent, or Firm* — Bracewell LLP; James E. Bradley

(57) ABSTRACT

A submersible well pump assembly has a pump, a motor, and a tubular pressure equalizer housing located between the pump and the motor. A rotatable drive shaft extends within the housing on the axis for driving the pump. A guide tube surrounds the drive shaft, defining an inner annulus between the drive shaft and the guide tube and an outer annulus between the housing and the guide tube. A well fluid inlet path admits well fluid into the outer annulus. A hub assembly is pivotally mounted to the guide tube. The hub assembly has a communication passage with having at least one lateral portion extending away the axis and a communication passage opening spaced from the axis and in fluid communication with the outer annulus. The hub assembly has a counterweight that rotates the communication passage opening to a point above the axis while the axis is horizontal.

17 Claims, 4 Drawing Sheets

(51) Int. Cl.

| | |
|---|---|
| ***F04D 29/08*** | (2006.01) |
| ***F04D 29/06*** | (2006.01) |
| *F04D 1/00* | (2006.01) |

(56) References Cited

U.S. PATENT DOCUMENTS

| | | | |
|---|---|---|---|
| 6,602,059 | B1 | 8/2003 | Howell et al. |
| 7,296,622 | B2 | 11/2007 | Wang |
| 7,654,315 | B2 | 2/2010 | Du et al. |
| 8,932,034 | B2 | 1/2015 | McKinney et al. |
| 2007/0051509 | A1 | 3/2007 | Selph |
| 2008/0031731 | A1 | 2/2008 | Orban et al. |
| 2009/0010773 | A1 | 1/2009 | Parmeter et al. |
| 2011/0236233 | A1 | 9/2011 | Merill |
| 2015/0023805 | A1 | 1/2015 | Pyron et al. |
| 2015/0104291 | A1 | 4/2015 | Kosmicki et al. |

OTHER PUBLICATIONS

International Search Report and Written Opinion dated May 22, 2017 for corresponding International Application No. PCT/US2017/017497.

LABYRINTH CHAMBER FOR HORIZONTAL SUBMERSIBLE WELL PUMP ASSEMBLY

CROSS REFERENCE TO RELATED APPLICATION

This application claims priority to provisional application S.N. 62/305,855, filed Mar. 9, 2016.

FIELD OF THE DISCLOSURE

This disclosure relates in general to electrical submersible well pump assemblies and in particular to a labyrinth chamber between the motor and pump for equalizing a pressure difference between motor lubricant and well fluid that is configured for horizontal wells.

BACKGROUND

Submersible well pump assemblies (ESP) are frequently used to pump well fluid from hydrocarbon wells. A typical ESP has a pump driven by a motor. A seal section or pressure equalizer, normally located between the motor and the pump, has components to equalize pressure of lubricant contained in the motor with the hydrostatic pressure of the well fluid on the exterior of the ESP. Those components may be a flexible diaphragm, a bellows, or a labyrinth chamber.

A labyrinth chamber has a labyrinth tube extending downward from a connector or adapter on the upper end of the labyrinth chamber. The upper end of the labyrinth tube is open as well as the lower end, which is spaced a short distance above the lower end of the labyrinth chamber. A guide tube surrounds the drive shaft extending from the motor. The guide tube has a port near the upper end of the chamber. Lubricant from the motor flows up an annular clearance between the shaft and the guide tube and out the guide tube port into the labyrinth chamber. Well fluid flows down the labyrinth tube into the labyrinth chamber into contact with the lubricant. The well fluid applies the hydrostatic pressure on the exterior of the ESP to the lubricant in the labyrinth chamber, which communicates that pressure to lubricant in the motor. The well fluid has a higher specific gravity than the lubricant, thus is inhibited from flowing upward in the labyrinth chamber into the guide tube port to reach the guide tube port. It is important to keep the corrosive well fluid from flowing down the guide tube into the motor.

A labyrinth chamber works well in vertical wells and provides pressure compensation without any additional moving parts. However, if the pump is installed in a horizontal section of the well, the path from the outlet of the labyrinth tube to the guide tube port is approximately horizontal rather than being vertical. The well fluid entering the labyrinth chamber could more easily flow along the horizontal flow path than the labyrinth flow path that exists while the ESP is oriented vertically.

SUMMARY

A submersible well pump assembly comprises a pump, a motor, and a pressure equalizer housing between the pump and the motor. The housing has an axis, a motor end connector and a pump end connector. A rotatable drive shaft extends within the housing on the axis through the motor end connector and the pump end connector. A hub assembly within the housing is pivotal about the axis relative to the housing. A well fluid inlet path admits well fluid into the housing. A communication passage in the hub assembly has a first opening in communication with lubricant in the motor and a second opening that is spaced laterally from the axis. A counterweight mounted to the hub assembly pivots the second opening of the communication passage above the axis while the axis is horizontal.

A non rotating guide tube through which the shaft extends may be located in the housing. In one embodiment, the hub assembly is pivotally mounted to the guide tube.

The communication passage may have an axially extending portion leading to the second opening of the communication passage, the axially extending portion being offset from the axis. A center point of the counterweight is located 180 degrees from the second opening of the communication passage.

In one embodiment, the guide tube has ends connected between the pump connector and the motor connector, The guide tube defines an inner annulus between the shaft and the guide tube and an outer annulus between the guide tube and the housing. In one embodiment, the inner annulus is in fluid communication with the lubricant in the motor, and the well fluid inlet path leads to the outer annulus. A guide tube port is within in the guide tube, The hub assembly is pivotally mounted to the guide tube in this embodiment, and the first opening of the communication passage registers with the guide tube port.

The hub assembly has a hub collar pivotally mounted to the guide tube in one embodiment. The hub collar contains a portion of the communication passage. A hub tube protrudes laterally from the hub collar and is in fluid communication with the communication passage in the hub collar. The hub tube may have a free end that points downward while the axis is horizontal. The second opening of the communication passage is at the free end of the hub tube.

In another embodiment, the hub assembly comprises a motor end ring having a motor end wall adjacent a shaft bore in the motor connector. The shaft bore is in fluid communication with the lubricant in the motor. An annular seal seals between the motor connector and the motor end wall radially outward from the shaft bore. A motor end ring first port extends through the motor end wall closer to the axis than the annular seal. A motor end ring second port is adjacent a periphery of the end ring. The communication passage extends within the motor end ring from the motor end ring first port to the motor end ring second port.

In one embodiment, a non rotating guide tube has a pump end secured to the pump connector and a motor end spaced axially from the motor connector. The guide tube defines an inner annulus between the shaft and the guide tube and an outer annulus between the guide tube and the housing. The hub assembly has a pump end ring pivotally mounted to the guide tube. A communication tube extends from the motor end ring outlet second port to the pump end ring, causing the pump end ring to pivot in unison with the motor end ring. The second opening of the communication passage is at a pump end ring end of the communication tube and leads to the outer annulus. A seal may be located between the shaft and the motor end ring. The well fluid inlet path leads to the inner annulus and from the inner annulus to the outer annulus.

Figure 1:
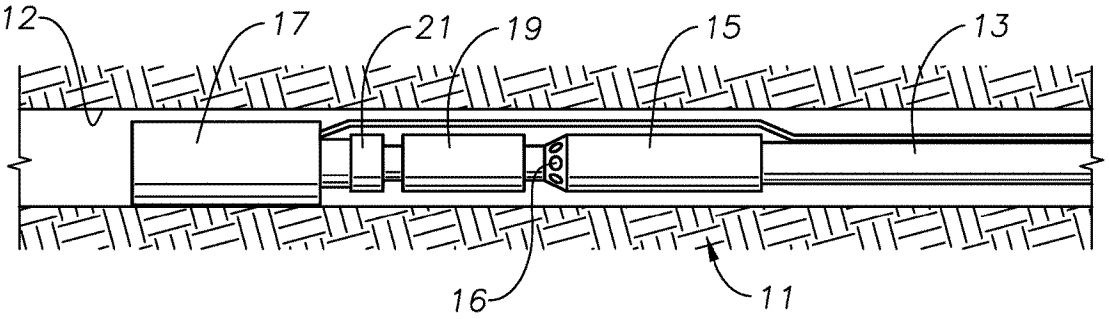
FIG. 1 is a schematic partially sectioned view of a submersible pump assembly having a labyrinth chamber in accordance with this disclosure.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE DISCLOSURE

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, electrical submersible pump assembly (ESP) 11 is illustrated as being supported on production tubing 13 extending into a cased inclined or horizontal section 12 of a well. ESP 11 could be supported by other structure instead of production tubing 13, such as coiled tubing. Also, ESP 11 could be operated within a vertical portion of a well.

ESP 11 includes several modules, one of which is a pump 15 that is illustrated as being a centrifugal pump. Pump 15 has an intake 16 for drawing in well fluid. Alternately, pump 15 could be other types, such as a progressing cavity pump. Another module comprises an electrical motor 17, which drives pump 15 and is normally a three-phase AC motor.

A third module comprises a pressure equalizing or seal section 19 coupled between pump 15 and motor 17. Seal section 19 has features to reduce a pressure differential between dielectric lubricant contained in motor 17 and the pressure of the well fluid on the exterior of ESP 11. Seal section 19 also accommodates thermal expansion of the motor lubricant. Intake 16 may be located in an upper portion of seal section 19 or on a lower end of pump 15. The terms "upper" and "lower" are used herein for convenience. While installed in a horizontal well section 12 as shown, "lower" refers to the upstream direction of well fluid flow, and "upper" refers to the downstream direction of well fluid flow. A thrust bearing unit 21 for motor 17 may be in a separate module or located in seal section 19 or motor 17.

ESP 11 may also include other modules, such as a gas separator for separating gas from the well fluid prior to the well fluid flowing into pump 15. The various modules may be shipped to a well site apart from each other, then assembled with bolts or other types of fasteners.

Figure 2:
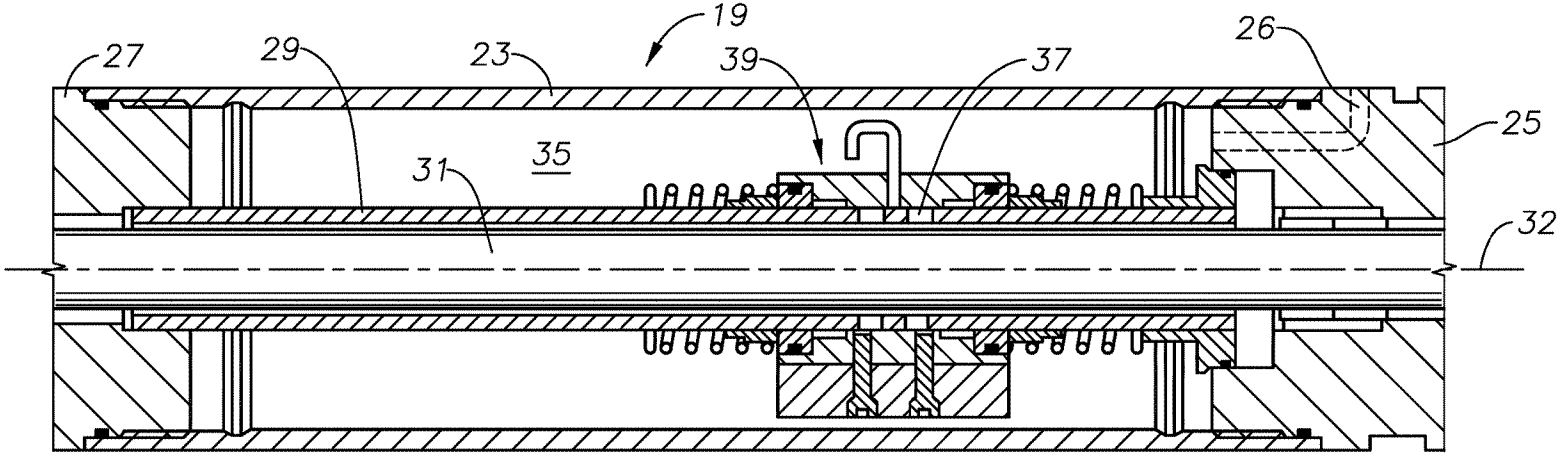
FIG. 2 is a schematic sectional view of labyrinth chamber of FIG. 1.

Referring to FIG. 2, seal section 19 has a cylindrical housing 23 secured by threads to pump end and motor end connectors 25, 27. Pump end connector 25 normally bolts to intake 16 of pump 15 (FIG. 1) or to another seal section located between seal section 19 and pump 15. Motor end connector 27 connects to thrust unit 21, motor 17 or another seal section located between seal section 19 and motor 17. If one of the connectors 25, 27 secures to another seal section (not shown) in tandem, the other seal section could be the same type or it could be a flexible bag or bellows type of seal section. Rather than bolting, pump end and motor end connectors 25, 27 could use threaded, rotatable collars.

Figure 3:
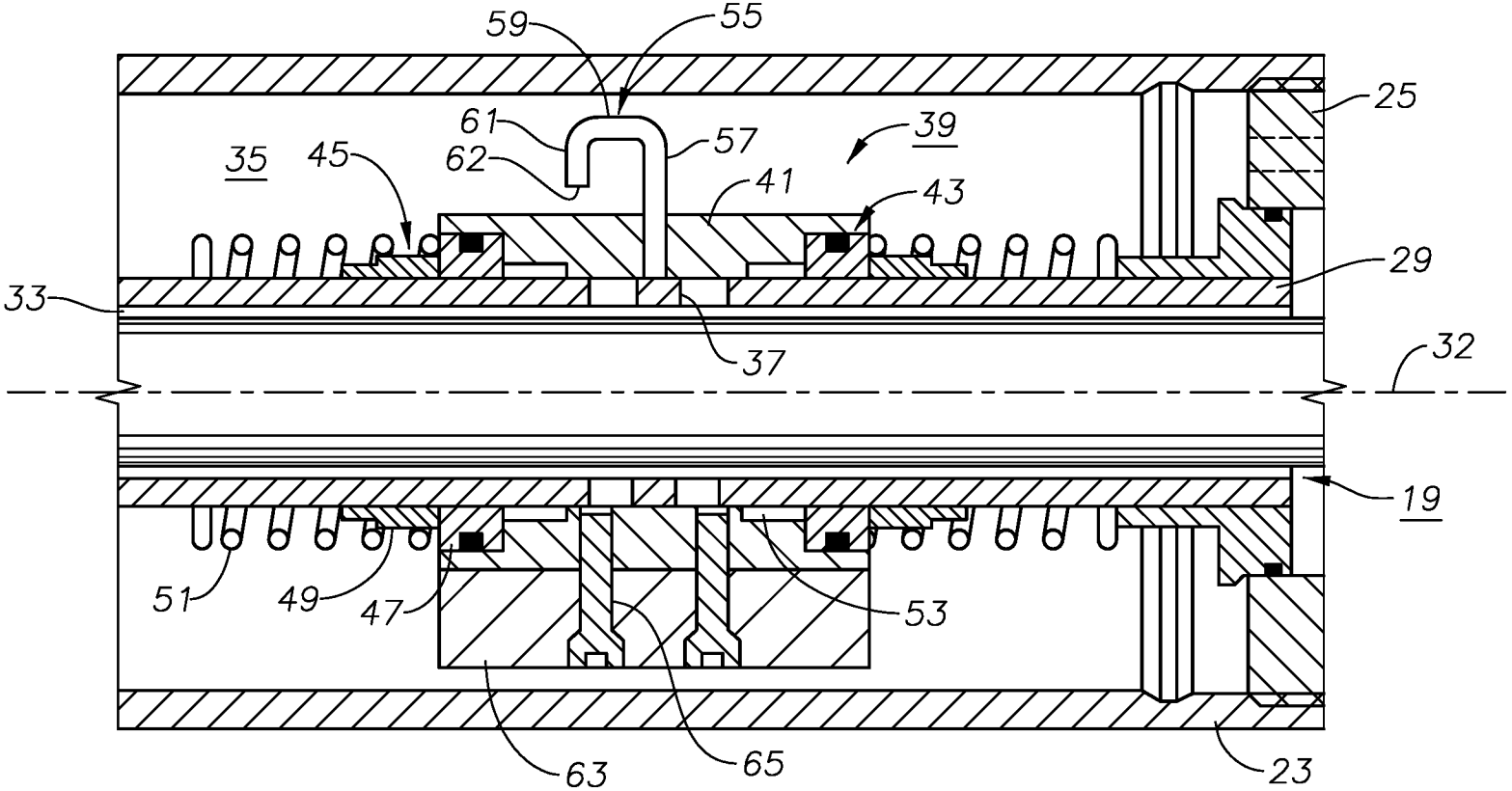
FIG. 3 is an enlarged schematic sectional view of the labyrinth chamber of FIG. 2

A guide tube 29 has one end sealed and secured to a bore within pump end connector 25. In the first embodiment, guide tube 29 has an opposite end sealed and secured to a bore within motor end connector 27. A drive shaft 31 rotated by motor 17 (FIG. 1) extends through the bores in connectors 25, 27 and through guide tube 29 along a longitudinal axis 32. Guide tube 29 does not rotate relative to housing 23. Referring to FIG. 3, guide tube 29 separates an inner annulus 33, which is between guide tube 29 and drive shaft 31, from an outer annulus 35, which is between guide tube 29 and housing 23. Guide tube 29 has one or more guide tube ports 37 that communicate inner annulus 33 with outer annulus 35. Guide tube ports 37 are shown located closer to pump end connector 25 than motor end connector 27, but that can vary.

A hub assembly 39 mounts around guide tube 29 and can pivotally rotate relative to guide tube 29. Referring to FIG. 3, hub assembly 39 has a hub collar 41, which is a short cylindrical member through which guide tube 29 extends. Hub collar 41 fits around a portion of guide tube 29 containing guide tube ports 37. Seals 43, 45 at opposite ends of hub collar 41 seal hub collar 41 to guide tube 29. In this example, hub seals 43, 45 are mechanical face seals so as to readily allow hub collar 41 to rotate an increment relative to guide tube 29. Each hub seal 43, 45 has a hub seal ring 47 that is rigidly attached to hub collar 41 and can pivotally rotate with hub collar 41. A guide tube seal ring 49 mounts to guide tube 29 for non-rotation relative to guide tube 29. A spring 51 urges guide tube seal ring 49 against hub seal ring 47 in sealing engagement. Hub seals 43, 45 define and seal a hub annulus 53 between hub collar 41 and guide tube 29 that is in communication with guide tube ports 37.

Hub assembly 39 has a hub tube 55 that extends laterally outward from hub collar 41 relative to axis 32. Hub tube 55 is generally J-shaped in this embodiment, with a leg or first lateral portion 57 that may be located on a radial line of axis 32. Hub tube 55 has an axial portion 59 that extends generally parallel with axis 32, but may be curved rather than straight as shown. Hub tube axial portion 59 extends from the outer end of first lateral portion 57. Hub tube axial portion 59 could be curved to provide a more J-shaped appearance for hub tube 55. Hub tube 55 has a second lateral portion or free end 61 that extends from axial portion 59 back toward axis 32, parallel with leg 57. Free end 61 has an open end 62, which defines a second opening for a communication passage extending from inner annulus 33. Open end 62 communicates fluid in hub annulus 53 with fluid in outer annulus 35.

Figure 4:
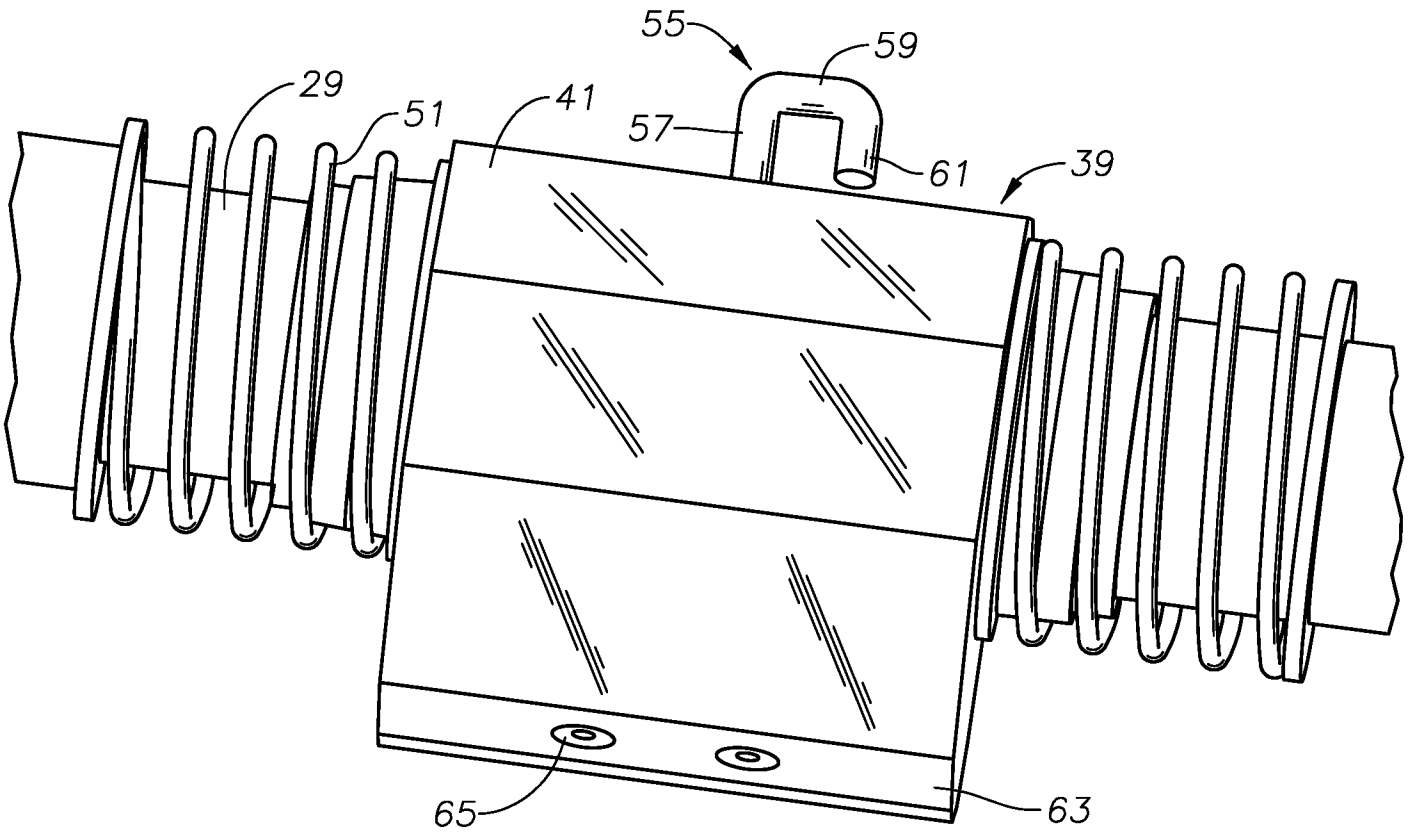
FIG. 4 is a perspective view of a hub assembly of the labyrinth chamber of FIG. 3.

Hub assembly 39 includes an eccentric counterweight 63 mounted on an opposite side of hub collar 41 from hub tube 55. A center point of counterweight 63 may be 180 degrees from hub tube 55. Counterweight 63 has a circumferential extent much less than 360 degrees so that it's entirely will pivot due to gravity to be below guide tube 29 when axis 32 is horizontal. Fasteners 65 secure counterweight 63 to hub collar 41. Counterweight 63 causes hub collar 41 to rotationally pivot and orient to a position with hub tube 55 extending upward from hub collar 41 while seal section 19 is horizontal. If desired, a bearing sleeve (not shown) or journal could be positioned between hub collar 41 and guide tube 29 to facilitate pivotal rotation of hub assembly 39. When seal section 19 is horizontal, open end 62 of hub tube free end 61 will be spaced above hub collar 41 and pointing downward. FIG. 4 illustrates a portion of the exterior of hub assembly 39.

During the deployment of ESP 11, as ESP 11 enters horizontal section 12, counterweight 63 will swing hub 39 to a position with hub tube 55 extending vertically upward. Well fluid flows into outer annulus 35 through well fluid inlet port 26 (FIG. 2). Some of the lubricant in motor 17 migrates from motor 17 into inner annulus 33 within guide tube 29. Some of the well fluid may flow from outer annulus 35 into hub tube 55 through a communication passages defined by hub annulus 53 and the interior of hub tube 55. The lubricant and the well fluid have an interface or point of contact, which equalizes the pressure of the lubricant with the pressure of the well fluid. The point of contact could be within hub tube 55 or within inner annulus 33 and varies during operation. As motor 17 operates, the lubricant heats up and expands, which changes the location of the interface. When motor 17 is turned off, the lubricant cools and shrinks in volume, again changing the location of the interface.

Lighter well fluid components, such as water, normally makes up a large portion of the well fluid, with oil normally being the remaining portion. Being heavier, water tends to migrate into lower portions of outer annulus 35, and the oil migrates into the upper portions of outer annulus 35. For water to flow into inner annulus 33, it must first migrate up to opening 62 in free end portion 61 of hub tube 55, then through the axial portion 59 and down first lateral portion 57 to hub annulus 53. Being heavier than the lubricant, water has difficulty migrating upward in free end portion 61. Hub tube 55 thus serves as a labyrinth flow path, retarding entry of water into inner annulus 33 and from there into motor 17.

Figure 5:
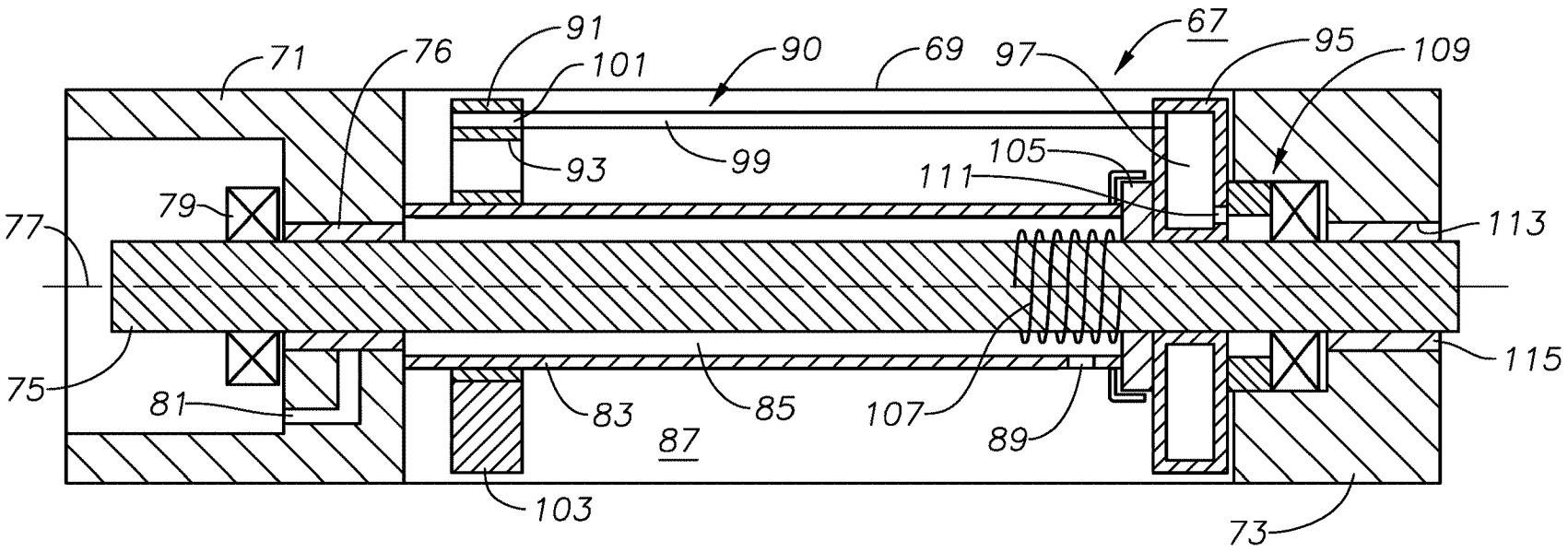
FIG. 5 is a schematic sectional view of an alternate embodiment of a labyrinth chamber.

FIG. 5 illustrates a second embodiment pressure equalizer or seal section 67. Seal section 67 has a housing 69 with a pump end connector 71 on one end and a motor end connector 73 on the opposite end. A drive shaft 75 rotated by motor 17 (FIG. 1) extends through housing 69 along an axis 77. A radial support bearing 76 in a bore in pump end connector 71 supports but does not seal around shaft 75. A mechanical seal 79 may be mounted around shaft 75 in pump end connector 71 to limit the entry of well fluid through bearing 76 into housing 69. In this example, a well fluid port 81 in pump end connector 71 conveys well fluid along a well fluid inlet path directly to bearing 76 and from there into the interior of a guide tube 83. Guide tube 83 secures and seals to pump end connector 71 but not to motor end connector 73.

Guide tube 83 surrounds shaft 75, defining an inner annulus 85 between guide tube 83 and shaft 75. The space between guide tube 83 and housing 69 comprises an outer annulus 87. Guide tube 83 has one or more guide tube ports 89 that communicate well fluid in inner annulus 85 with outer annulus 87. In this example, guide tube port 89 is near an end of guide tube 83 opposite pump end connector 71, but the location can vary.

A hub assembly 90 pivotally mounts around guide tube 83 for rotation relative to guide tube 83. Hub assembly 90 includes a first or pump end ring 91 rotatably mounted on guide tube 83. Pump end ring 91 may have one or more openings 93 from one side to the other to facilitate well fluid flow in outer annulus 87 from one side to the other of pump end ring 91. Hub assembly 90 also has a second or motor end ring 95 axially spaced from pump end ring 91. Motor end ring 95 mounts to shaft 75 instead of guide tube 83. A bearing sleeve (not shown) may be located between motor end ring 95 and shaft 75 to facilitate rotation of shaft 75 relative to motor end ring 95. Motor end ring 95 has an internal passage or communication cavity 97 extending from an outer to an inner portion of motor end ring 95.

A rigid communication tube 99 extends axially between outer peripheral portions of pump end ring 91 and motor end ring 95. Communication tube 99 is parallel with and offset from axis 77. Communication tube 99 has an open end 101 at pump end ring 91 to communicate fluid in the interior of communication tube 99 with well fluid in outer annulus 87. The opposite end of communication tube 99 joins and is in fluid communication with motor end ring cavity 97.

A counterweight 103 mounts eccentrically to one of the rings 91, 95, which in this example is pump end ring 91, but it could be the other. Counterweight 103 is located 180 degrees from communication tube 99 so that it will pivot communication tube 99 to a position above and parallel with guide tube 83 when seal section 67 is oriented horizontally. Communication tube 99 causes pump end ring 91 and motor end ring 95 to rotationally pivot in unison relative to guide tube 83.

A seal 105 mounts to shaft 75 between the motor end of guide tube 83 and motor end ring 95. Seal 105, which may be a mechanical face seal, rotates with shaft 75. A spring 107 urges seal 105 in sliding and sealing engagement with a pump side portion of motor end ring 95. Seal 105 reduces the entry of well fluid in outer annulus 87 from flowing into motor end connector 73.

Another seal assembly 109 locates on the opposite side of motor end ring 95 from seal 105. Seal assembly 109 may have multiple components, including a portion that rotates with shaft 75 and is in sliding engagement with a motor side portion of motor end ring 95. A cavity port 111 in motor end ring 95 communicates cavity 97 with a bore 113 of motor end connector 73. Cavity port 111 is located radially inward from the portion where seal assembly 109 slides against motor end ring 95. A bearing 115 in motor end connector 73 supports shaft 75 but does not seal. Motor lubricant from motor 17 (FIG. 1) is free to communicate through shaft bearing 115 in bore 113 along a communication passage through cavity port 111 and into cavity 97. The communication passage continues through communication tube 99 and out open ends 101. Seal 109 prevents motor lubricant in bore 133 from flowing directly into outer annulus 87 rather than into cavity 97.

In the operation of the FIG. 5 embodiment, when seal section 67 is being oriented horizontally, counterweight 103 will rotationally pivot pump end ring 91 and motor end ring 95 to position communication tube 99 above guide tube 83. Well fluid entering inner annulus 85 from well fluid inlet 81 flows out guide tube port 89 into outer annulus 87. The lighter components of the well fluid migrate upward into communication tube inlet 101. Heavier components, namely water, tend to stay in the lower portion of outer annulus 87.

Motor lubricant from motor 17 (FIG. 1) migrates past seal assembly 109 through cavity port 111 and cavity 97 into an opposite end of communication tube 99.

The well fluid and lubricant interface with each other at some point, which may be within communication tube 99, applying the hydrostatic pressure of the well fluid to the motor lubricant. In order for water in the well fluid to migrate into motor end connector bore 113, the water would have to flow along a labyrinth flow path. The flow path requires upward flow in outer annulus 87 to communication tube open end 101, then along the axial portion of hub assembly 90, which is communication tube 99, then downward in cavity 97, which serves as a lateral portion of hub assembly 90.

The present invention described herein, therefore, is well adapted to carry out the objects and attain the ends and advantages mentioned, as well as others inherent therein. While two presently preferred embodiments of the invention have been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A submersible well pump assembly, comprising:

a pump;

a motor;

a pressure equalizer housing between the pump and the motor, the housing having an axis, a motor end connector and a pump end connector;

a rotatable drive shaft extending within the housing on the axis through the motor end connector and the pump end connector;

a hub assembly in the housing through which shaft extends, the hub assembly being pivotal about the axis relative to the housing;

a well fluid inlet path that admits well fluid into the housing;

a communication passage in the hub assembly that has a first opening in communication with lubricant in the motor and a second opening that is spaced laterally from the axis;

a counterweight mounted to the hub assembly that pivots the second opening of the communication passage above the axis while the axis is horizontal;

a non rotating guide tube through which the shaft extends, the guide tube having a pump end adjacent the pump end connector and a motor end adjacent the motor end connector; and wherein the hub assembly is pivotally mounted to the guide tube.

2. The pump assembly according to claim 1, wherein:

the communication passage has an axially extending portion leading to the second opening of the communication passage, the axially extending portion being offset from the axis.

3. The pump assembly according to claim 1, wherein a center point of the counterweight is located 180 degrees from the second opening of the communication passage.

4. The pump assembly according to claim 1, further comprising:

an inner annulus between the shaft and the guide tube and an outer annulus between the guide tube and the housing;

the inner annulus being in fluid communication with the lubricant in the motor, and the well fluid inlet path leading to the outer annulus;

a guide tube port in the guide tube; and wherein the first opening of the communication passage registers with the guide tube port.

5. The pump assembly according to claim 4 wherein the hub assembly further comprises:

a hub collar pivotally mounted to the guide tube, the hub collar containing a portion of the communication passage;

a hub tube protruding laterally from the hub collar and in fluid communication with the communication passage in the hub collar; wherein the hub tube has a free end that points downward while the axis is horizontal; and the second opening of the communication passage is at the free end of the hub tube.

6. The pump assembly according to claim 1, wherein the hub assembly comprises:

a motor end ring having a motor end wall adjacent a shaft bore in the motor end connector, the shaft bore being in fluid communication with the lubricant in the motor;

an annular seal that seals between the motor end connector and the motor end wall radially outward from the shaft bore;

a motor end ring first port extending through the motor end wall closer to the axis than the annular seal;

a motor end ring second port adjacent a periphery of the end ring; and wherein the communication passage extends within the motor end ring from the motor end ring first port to the motor end ring second port.

7. The pump assembly according to claim 6, wherein:

the guide tube defining an inner annulus between the shaft and the guide tube and an outer annulus between the guide tube and the housing;

the hub assembly further comprises:

a pump end ring pivotally mounted to the guide tube;

a communication tube extending from the motor end ring second port to the pump end ring, causing the pump end ring to pivot in unison with the motor end ring; and the second opening of the communication passage is at a pump end ring end of the communication tube and leads to the outer annulus.

8. The pump assembly according to claim 7, further comprising:

a seal between the shaft and the motor end ring; and wherein the well fluid inlet path leads to the inner annulus and from the inner annulus to the outer annulus.

9. A submersible well pump assembly, comprising:

a pump;

a motor;

a tubular pressure equalizer housing located between the pump and the motor and having an axis;

a rotatable drive shaft extending within the housing on the axis for driving the pump;

a guide tube surrounding the drive shaft, defining an inner annulus between the drive shaft and the guide tube and an outer annulus between the housing and the guide tube;

a well fluid inlet path that admits well fluid into the outer annulus;

a hub assembly mounted to the guide tube and being rotatable relative to the guide tube;

the hub assembly having a communication passage with a fluid communication passage first opening that is in communication with lubricant in the motor, the communication passage having at least one lateral portion extending away the axis and having a communication passage second opening spaced from the axis and in fluid communication with the outer annulus; and the hub assembly having a counterweight that rotates the communication passage second opening to a point above the axis while the axis is horizontal, requiring any water in the well fluid within the outer annulus to flow upward to reach the communication passage second opening.

10. The assembly according to claim 9, wherein:

the guide tube has a guide tube port; and the hub assembly comprises:

a hub collar that extends rotatably around a portion of the guide tube having the guide tube port, defining a hub annulus between the guide tube and the hub collar that is in fluid communication with the guide tube port, the counterweight being secured to the hub collar;

seals that seal the hub annulus to the guide tube; and wherein the hub annulus defines the communication passage first opening.

11. The assembly according to claim 9, wherein:

the guide tube has a guide tube port; and the hub assembly comprises:

a hub collar that extends rotatably around a portion of the guide tube having the guide tube port, the counterweight being secured to the hub collar;

a hub tube joining and extending laterally from the hub collar, the hub tube being in fluid communication with the guide tube port; and wherein the hub tube has an open end in communication with the outer annulus and which defines the communication passage second opening.

12. The assembly according to claim 9, wherein:

the guide tube has a guide tube port; and the hub assembly comprises:

a hub collar that extends rotatably around a portion of the guide tube having the guide tube port, the counterweight being secured to the hub collar; and a generally J-shaped hub tube joining and having a lateral portion extending laterally from the hub collar, the hub tube having an axially extending portion extending axially from the lateral portion, the hub tube having a free open end extending from the axially extending portion laterally back toward the hub collar; and wherein the free open end of the hub tube defines the second opening of the communication passage.

13. The assembly according to claim 9, further comprising:

a motor end connector on one end of the housing, the motor end connector having a bore through which the drive shaft extends, defining a bore annulus that is in fluid communication with the motor lubricant in the motor;

wherein the hub assembly comprises:

first and second rings axially spaced apart from each other, the second ring having a cavity in fluid communication with the bore annulus, the cavity defining the a first portion of the communication passage;

the counterweight being mounted to one of the end rings; and a communication tube extending axially between the first and second rings and offset from the guide tube, causing the first and second rings to pivotally rotate in unison, the communication tube having a first opening in the cavity and a second opening that defines the second opening of the communication passage in fluid communication with the outer annulus.

14. A method of pumping well fluid from a well having a horizontal section with a submersible well pump assembly having a pump, a motor, and a pressure equalizer housing between the pump and the motor, the housing having an axis, a motor end connector and a pump end connector with a rotatable drive shaft extending within the housing on the axis through the motor end connector and the pump end connector, the method comprising:

extending the shaft through a non rotating guide tube;

pivotally mounting a hub assembly to the guide tube in the housing around the shaft, the hub assembly having a communication passage that has first opening in communication with lubricant in the motor and a second opening that is spaced laterally from the axis;

mounting a counterweight eccentrically to the hub assembly;

lowering the pump assembly into a horizontal section of the well;

with the counterweight, pivoting the second opening of the communication passage above the axis;

communicating well fluid into the housing and immersing the second opening of the communication passage in the well fluid;

communicating lubricant into the communication passage through the first opening of the communication passage; and requiring any heavier components within the well fluid in the housing to migrate upward in order to enter the second opening of the communication passage.

15. The method according to claim 14, wherein:

the communication passage has a laterally extending portion that leads downward to the second opening of the communication passage, and the method further comprises:

requiring any heavier components within the well fluid in the housing to migrate upward through the laterally extending portion in order to reach the second opening of the communication passage.

16. The method according to claim 14, wherein:

the communication passage has a lateral portion extending laterally from the first opening, an axial portion extending axially from the lateral portion; and the method further comprises:

requiring any heavier components with the well fluid in the housing to migrate along the axial portion in order to reach the first opening of the communication passage.

17. The method according to claim 14, wherein:

the communication passage has a first lateral portion extending laterally from the first opening, an axial portion extending axially from the first lateral portion and a second lateral portion extending from the axial portion toward the axis; and the method further comprises:

requiring any heavier components with the well fluid in the housing to migrate upward along the second lateral portion, then along the axial portion and the first lateral portion in order to reach the first opening of the communication passage.

* * * * *